US006598807B1

(12) United States Patent
Anzalone

(10) Patent No.: US 6,598,807 B1
(45) Date of Patent: Jul. 29, 2003

(54) SPRAYING DEVICE WITH WIDE SPRAY ARC

(76) Inventor: John Anzalone, 3905 Batavia-Elba Twn Ln Road, Oakfield, NY (US) 14125

( * ) Notice: Subject to any disclaimer, the term of this patent is extended or adjusted under 35 U.S.C. 154(b) by 0 days.

(21) Appl. No.: 10/150,627

(22) Filed: May 17, 2002

(51) Int. Cl.[7] ..... A62C 13/62; A62C 13/66; B05B 9/03; F42B 3/00; F42B 10/00

(52) U.S. Cl. ..... 239/302; 239/322; 239/337; 239/558; 239/561; 102/324; 102/328; 102/502; 102/513

(58) Field of Search ..... 239/320, 321, 239/322, 337, 373, 548, 556, 558, 559, 561, DIG. 14, 597, 598, 246, 225.1; 169/36, 33; 102/324, 328, 392, 482, 281, 293, 498, 513, 502; 446/176, 193, 197, 398, 400, 437, 473, 267; 473/577

(56) References Cited

U.S. PATENT DOCUMENTS

| | | | | |
|---|---|---|---|---|
| 1,815,300 A | | 6/1931 | Harris | |
| 2,367,027 A | * | 1/1945 | Jackman | 46/200 |
| 3,528,662 A | | 9/1970 | Merchant et al. | |
| 3,782,286 A | | 1/1974 | Jones et al. | |
| 3,785,569 A | * | 1/1974 | Helmrich | |
| 3,791,303 A | | 2/1974 | Sweeney et al. | |
| 3,878,639 A | * | 4/1975 | Scheelar et al. | 46/1 R |
| 4,627,354 A | | 12/1986 | Diamond et al. | |
| 4,656,092 A | | 4/1987 | Haman et al. | |
| 4,932,672 A | | 6/1990 | Tippmann | |
| 5,018,449 A | | 5/1991 | Eidson, II | |
| 5,240,450 A | * | 8/1993 | Graham | 446/267 |
| 5,590,886 A | | 1/1997 | Lush | |
| 5,967,916 A | | 10/1999 | Robeson | |
| 6,242,489 B1 | | 6/2001 | Pinney | |
| 6,289,819 B1 | | 9/2001 | Dolderer | |
| 6,352,032 B1 | | 3/2002 | Pinney | |

* cited by examiner

*Primary Examiner*—Kevin Shaver
*Assistant Examiner*—Anuradha Ramana
(74) *Attorney, Agent, or Firm*—Christopher E. Blank; Jaeckle Fleischmann & Mugel, LLP

(57) ABSTRACT

The present invention comprises a casing with an opened end for receiving a liquid and a holding end where the liquid is stored. Between the open end and the holding end there narrow neck. A ball is placed into the opened end of the casing, so that lodging the ball into the neck will seal the neck area so that the liquid contained within the holding area will remain in the holding area until the ball is dislodged upon impact. Attached to the opened end of the casing is a nozzle. The nozzle serves two purposes, first it assures that the liquid contained within the casing does not quickly run out of the device upon impact minimizing the spray area covered by the liquid. Additionally the nozzle contains a number of holes distributed throughout the surface of said nozzle, so that the passage of liquid through the nozzle will cause the device to flail erratically, further maximizing the area sprayed by the device.

9 Claims, 9 Drawing Sheets

FIG. 7A
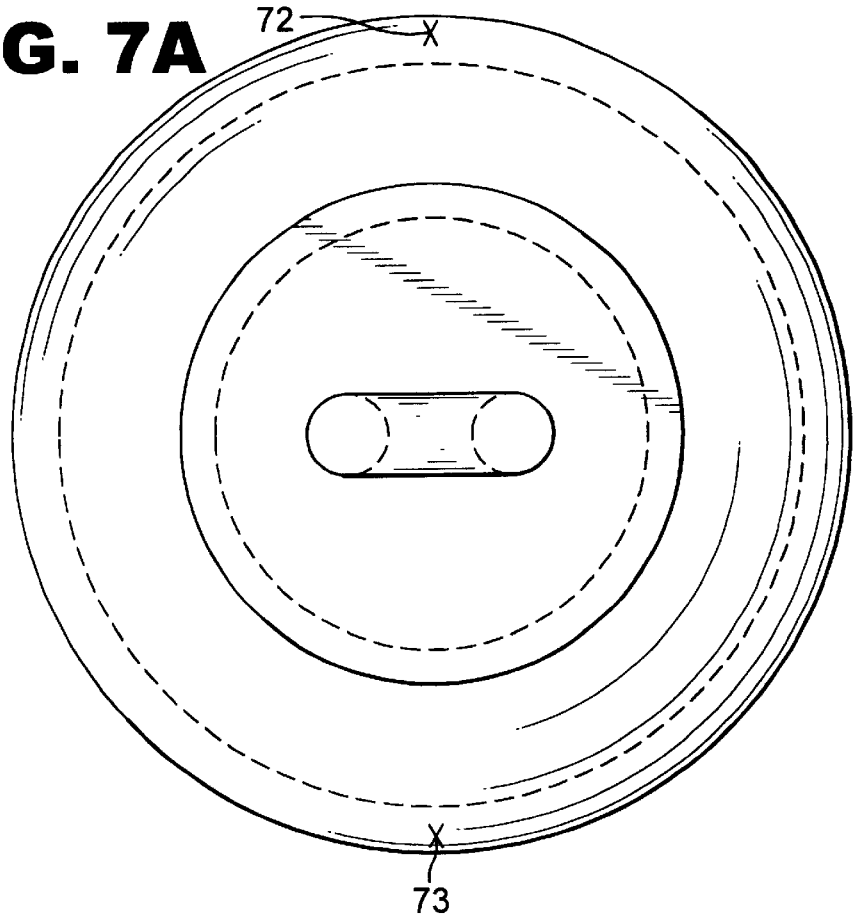
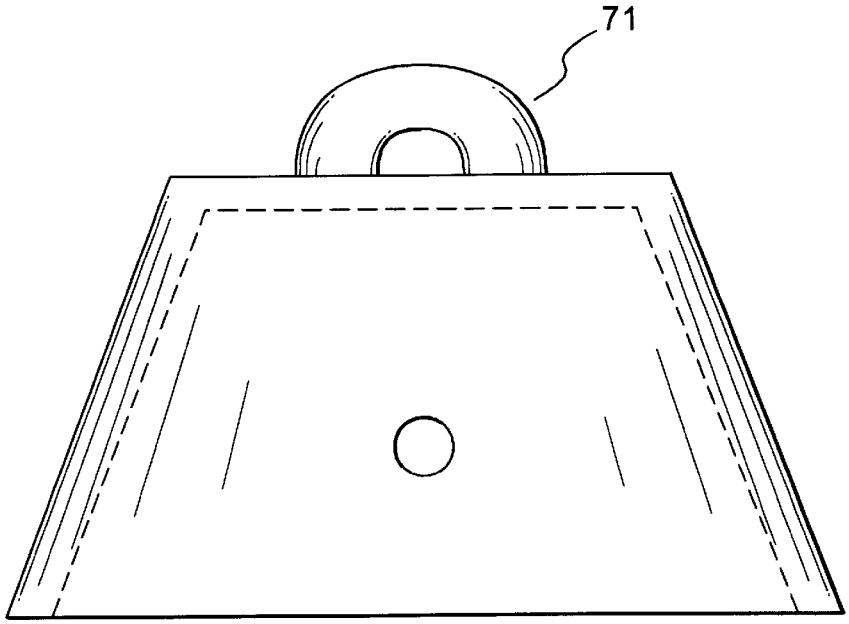
FIG. 7B

SPRAYING DEVICE WITH WIDE SPRAY ARC

TECHNICAL FIELD

The present invention relates to liquid spraying device and more particularly, to a reusable impact actuated liquid spraying device.

BACKGROUND OF THE INVENTION

The sport of paint ball in which individuals or teams of players participate in simulated war games has become increasingly popular in recent years. Generally, participants utilize various paint based weapons which discharge a marking liquid to identify the players that have been hit without causing serious bodily injury. As the sport has grown in popularity, paint ball weapons have evolved from single shot pistols and rifles to include automatic weapons and other devices based on actual combat weaponry. These devices enhance the realism of such a simulated war game. Devices have been developed, attempting to spray the liquid contained within over a wide area. Because many of these devices are not reusable, or contain components that need replacement, the expense incurred is excessive. Also, devices have been developed that are extremely complex in design. For instance, U.S. Pat. No. 5,018,449 teaches a spring loaded paint ball grenade with a series of levers, pistons and springs. Such a complex devices are expensive, and tend to malfunction under continuous use. Additionally, other devices that are reusable employ casings with seams, or are held together by crimps. For example, U.S. Pat. No. 4,932,672 teaches a paint ball grenade with one end of the internal cavity sealed by a crimp. This design greatly reduce the pressure that the casing can withstand, and also limits the amount of liquid held. Also, the wide opening in the casing, from which the liquid is dispersed, causes the device to abruptly expel its contents in the proximate area of impact. This combination leads to a liquid disbursement device that will spray a relatively small area. Furthermore, such a design also greatly reduces the life expectancy of the device and leads to additional expense.

Therefore, what is needed in the art is a liquid spraying device that is reusable to reduce the expense incurred in participating in these games.

Additionally, what is needed in the art is a reusable liquid spraying device ruggedly constructed to maximize the amount of liquid that it can contain as well as the amount of pressure that it can withstand.

SUMMARY OF THE INVENTION

The present invention provides a liquid spraying device that is constructed of a single seamless casing, and a nozzle that will assure that the liquid dispersed by the device will cover a wide area.

The present invention comprises a casing with an opened end for receiving a liquid and a holding end where the liquid is stored. Between the open end and the holding end there narrow neck. A ball is placed into the opened end of the casing, so that lodging the ball into the neck will seal the neck area so that the liquid contained within the holding area will remain in the holding area until the ball is dislodged upon impact. Attached to the opened end of the casing is a nozzle. The nozzle serves two purposes, first it assures that the liquid contained within the casing does not quickly run out of the device upon impact minimizing the spray area covered by the liquid. Additionally the nozzle contains a number of holes distributed throughout the surface of said nozzle, so that the passage of liquid through the nozzle will cause the device to flail erratically, further maximizing the area sprayed by the device.

To further assure that the device will not inadvertently disperse the liquid, an additional safety measure is incorporated into the present invention. The ball is first inserted into the neck region an adequate distance to assure that the opened end and a portion of the neck region can be folded, this fold further secures the ball within the neck of the casing. A cap is then placed above the fold to maintain the fold, and keeping this cap in place, a pin passes through opposite ends of the cup and under the fold in the neck.

When the device is used the pin should be removed from the device. The removal of the pin will also free the cap from the fold in the neck. The device can now be tossed or otherwise projected in a desirable direction. Upon impact the ball will become dislodged from the neck, and the device will flail erratically spraying a wide region. To further identify the area that is sprayed the liquid contained within the casing can be a marking liquid or paint.

An advantage of this device is the single seamless construction of the casing. This rugged casing assures that the device will not tear or come apart upon impact. The ruggedness of the device assures that the device can be used numerous times and eliminates the need to purchase replacements.

Another advantage of the present invention is that its single seamless construction allows for the maximum amount of liquid to contained within the device without concern for stressed seams or clips. A large volume of liquid contained under high pressure assures that the area that the liquid will spray upon impact will be maximized. It is very desirable for liquid spraying devices used for such a purpose to have the ability to spray as great an area as possible.

A further advantage of the present invention is related to the design of the nozzle. The nozzle, attached to the opened end of the casing has holes spaced throughout the surface of the nozzle that will cause the liquid spraying device to flail erratically as the liquid passes through the nozzle thus maximizing the area reached by the spray.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein:

FIG. 7*a* shows a top view of a release device that allows the device to be used as a trapstring actuated device.

FIG. 7*b* shows a side view of a release device that allows the device to be used as a trapstring actuated device.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF EMBODIMENTS

Figure 1:
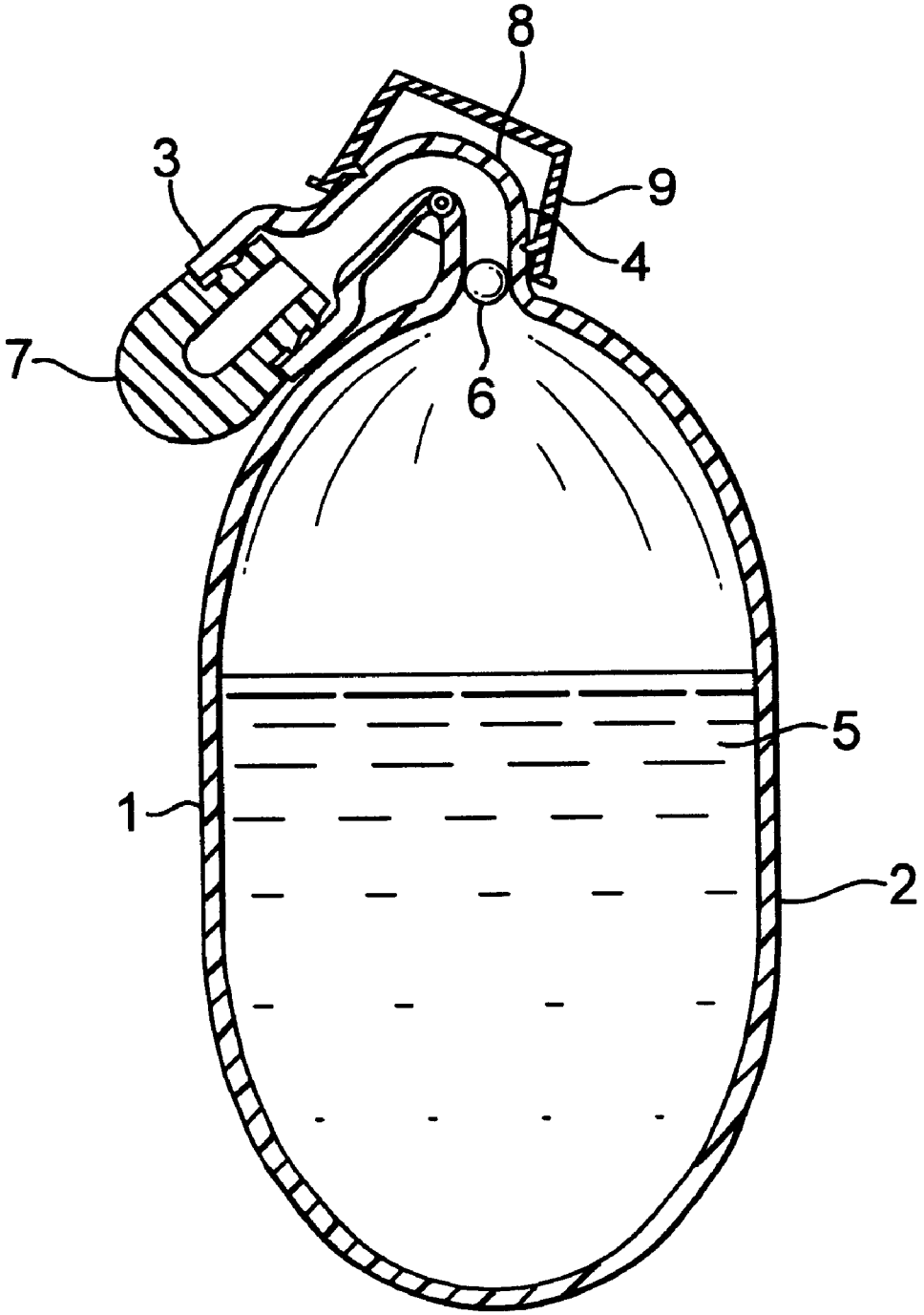
FIG. 1 is a view of the cross section of the liquid spraying device with safety cap sitting above the fold in the neck.

Referring to the drawings, and particularly to FIG. 1, there is shown one embodiment of the liquid spraying device of the present invention. The drawing depicts a single seamless one-piece molded casing 1, with a holding end 2 and an opened end 3. Between the holding end 2 and the opened end 3 is a narrow neck region 4. A liquid 5 is poured into the casing 1 through the opened end 3 and fills the holding end 2. A ball 6 is then lodged into the neck region 4 to assure that the liquid remains contained in the holding end 2 until impact. A nozzle 7 is then attached to the opened end 6 of the casing. The neck is then folded 8 and a cup 9 is placed on top of the fold. This cup 9 will assure that the neck remains folded while handling. To further assure that the cup 9 remains in contact with the folded casing, a pin (not shown) passes through holes on opposite sides of the cup 9 and underneath the fold in the neck of the casing.

To further ensure stability and reduce the chances of unexpected dispersion of the liquid paint, a groove in the neck of the casing can be used to hold the check valve- or ball. Thus, only when a change of pressure, or a pulse significant to dislodge the ball (check valve) is experienced by the device, will the device dispense paint.

Figure 2:
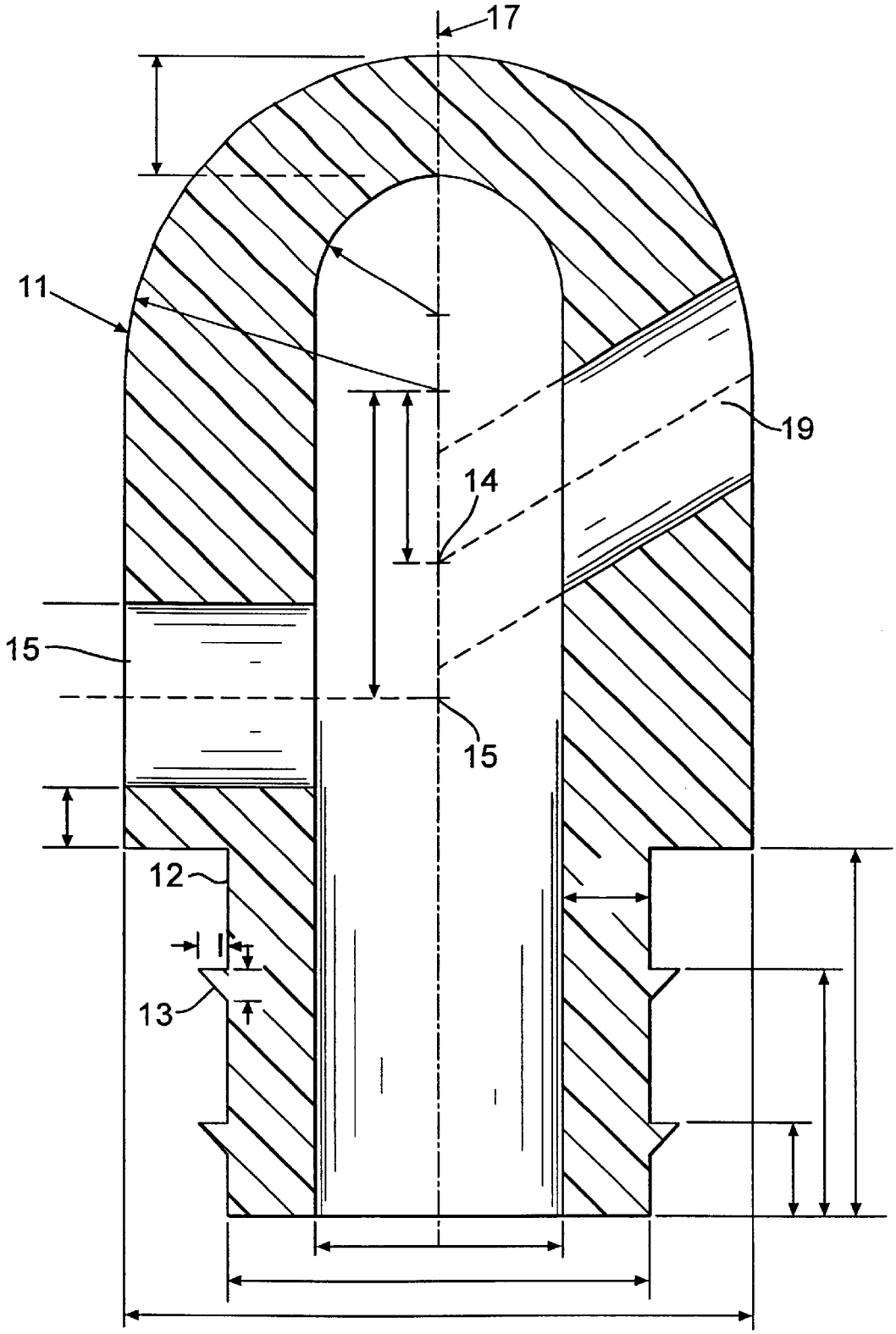
FIG. 2 is a cross sectional side view of the nozzle.

The positioning of the holes in the nozzle will play an important role in the action of the device upon impact. FIG. 2 is a cross sectional side view of the nozzle. FIG. 2 shows the upper portion of the nozzle 11 where the holes are located, as well as the location of the teeth 13 in the lower end of the nozzle 12 that assure that the nozzle remains affixed to the opened end of the casing. Additionally, FIG. 2 provides the thickness of the nozzle housing and the internal volume of the nozzle. Finally, FIG. 2 provides the locations where the center points of the upper hole set 14, and the lower hole set 15 would bisect the longitudinal axis 17 of the nozzle.

Figure 3:
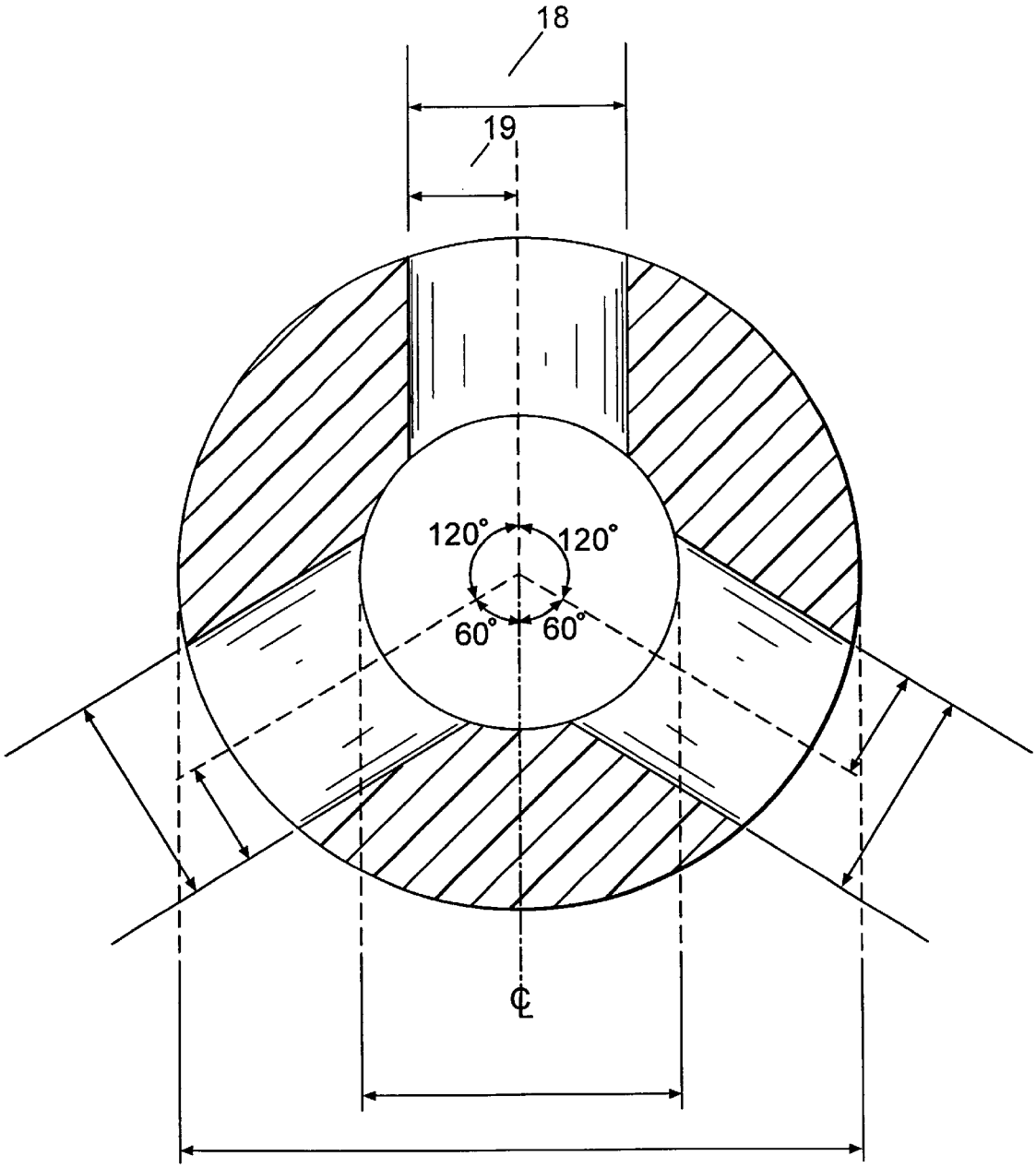
FIG. 3 is a top view of the nozzle showing the upper hole pattern.

FIG. 3 gives greater detail to the positioning and dimensions of the upper holes. As shown in FIG. 2 the upper group of holes enter the nozzle casing and continue through the nozzle casing such that the center point of the upper holes, if extended, would bisect the longitudinal axis 17 at about a 30 degrees angle. FIG. 3 shows the diameter 18 of holes, about 0.2 inches, the radius 19 of holes to be about 0.1 inch. FIG. 3 also shows that the three holes are equidistant from each other on the outer perimeter of the nozzle, or about 120 degrees.

Figure 4:
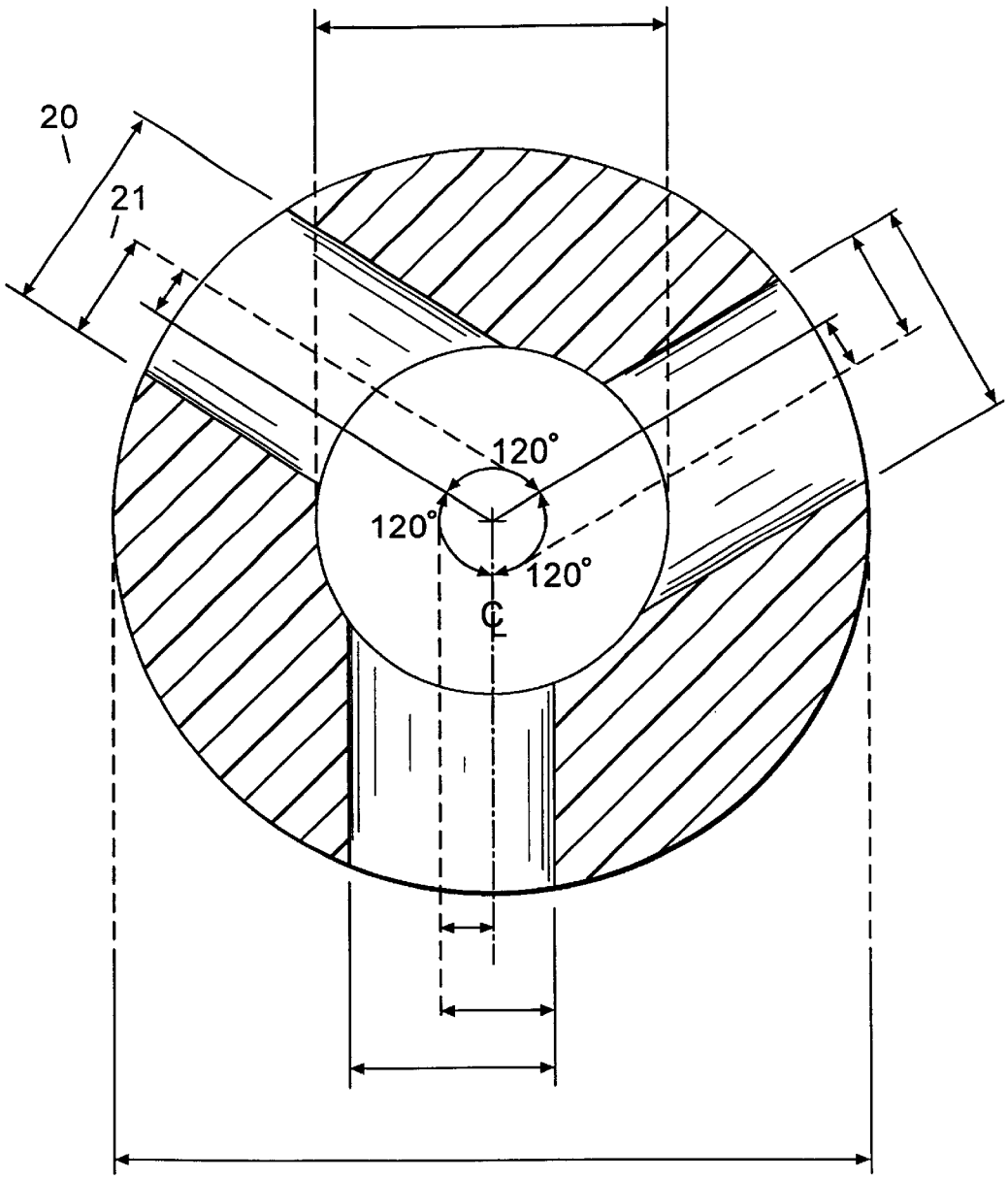
FIG. 4 is a top view of the nozzle showing the lower hole pattern.

FIG. 4 gives greater detail to the positioning and dimensions of the lower holes. As shown in FIG. 2 the lower group of holes enter the nozzle casing and continue through the nozzle casing perpendicular to the longitudinal axis of the nozzle. FIG. 4 shows the the diameter 20 of the holes, the radius 21 of the holes (about 0.1 inches), and also shows that the three holes are equidistant from each other. Additionally, this view shows the radius of the three holes is offset to the left. It is this combination of upper and lower hole angles that creates a more tortuous path for the water passing through these holes, causing the device to flail erratically and increasing the area sprayed by the device. Operationally, the invention may have more or less holes and may have a set of holes that dispense paint in such a fashion to induce spin along the major axis of the device.

Figure 5:
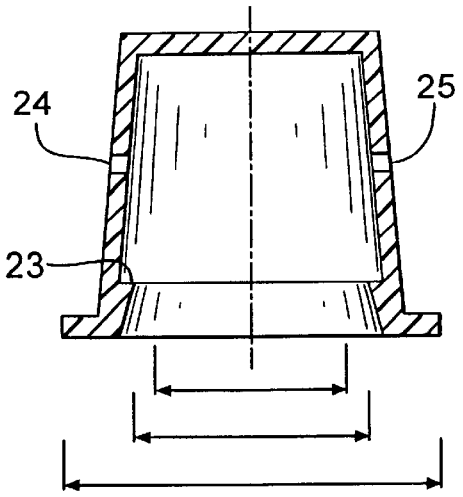
FIG. 5 is a cross sectional side view of the cap.
Figure 6:
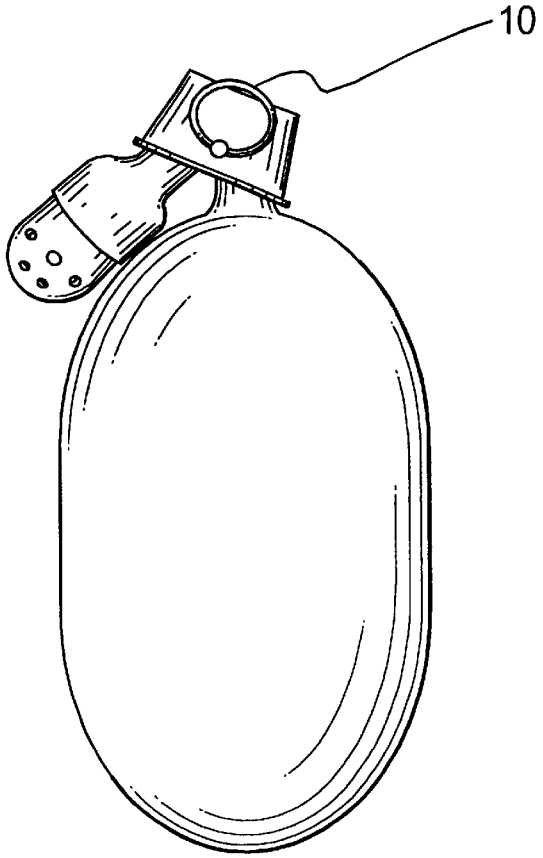
FIG. 6 is a three quarters perspective view of one embodiment of the device.

FIG. 5 is a cross sectional side view of the cap, further providing all appropriate dimensions. A cotter pin and attached key ring (not shown) are further provided to complete the cap assembly. In operation, the present device is loaded with about 4 to 16 fl.oz. of "paint" (5) which expands the elastic reservoir (2) of the device. The liquid paint thus provides a pressure to the check valve (6) in the fill/discharge conduit, effectively sealing said conduit when the neck of the device is crimped over and held in place by the retaining cup (9) and pin (10). When the pin is removed, the device can be thrown by the user. Upon impact, the retaining cup (9) dislodges, the neck (4) straightens, thus straightening the fill/discharge conduit. Resultant pressure dislodges the check valve (6) and the pressurized paint is supplied to the nozzle (7). The paint flowing to said nozzle exits through the wide arc holes (14) and the spin inducing holes (15), then later provides additional spin to the device as a whole ensuring as effective and widespread dispersion of the paint.

The seamless one-piece molded casing has a one-piece reservoir and one opening through which the reservoir is filled with liquid paint and through which the liquid paint is expelled upon use of the device. This seamless one-piece molded casing is made by dip molding on a die using an elastic dip molding material which those skilled in the art are well-versed in and are commercially used to treat the handle of hand tools and the like. Since this casing provides the fluid pressure for dispersing the liquid paint, the radius of liquid paint dispersion can be designed by varying the wall thickness of the casing and the volume of liquid paint in the reservoir. The relaxed or unfilled shape of the reservoir can also be used or varied to affect liquid paint pressure.

The retaining cap of one embodiment (FIG. 5) of the invention has a radial lip (23) to hold the folded over neck of the casing, and two holes (24 and 25) to hold the retaining pin (10) that holds the retaining cap be being inserted into the crux of the folded neck (see FIG. 1).

In another variation the crimp cap shown in FIGS. 7*a* and 7*b* has a loop (71) affixed to the top of the cup through which a trip-wire can be threaded. In operation a trip wire is affixed to the cap and the device is suspended on the trip-wire. The trip-wire may also be affixed to the cotter-pin that has been threaded through the two cotter-pin holes (72,73) and when stresses are applied to the trip-wire the cotter-pin is removed and the device falls from retaining cap, spraying its intended game victim.

Figure 8A:
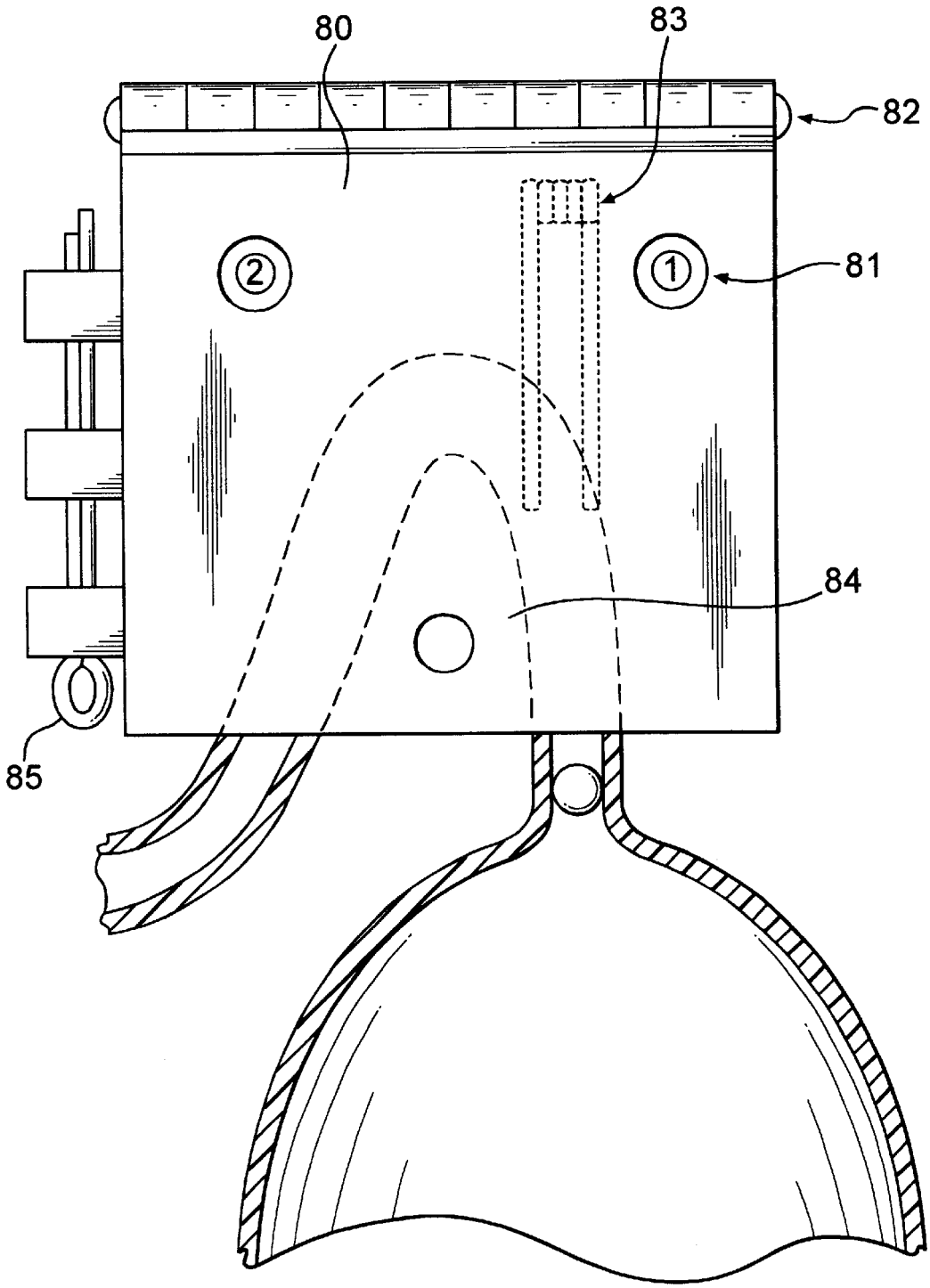
FIG. 8*a* shows a variation of a crimping cup that acts as a drop clip.
Figure 8B:
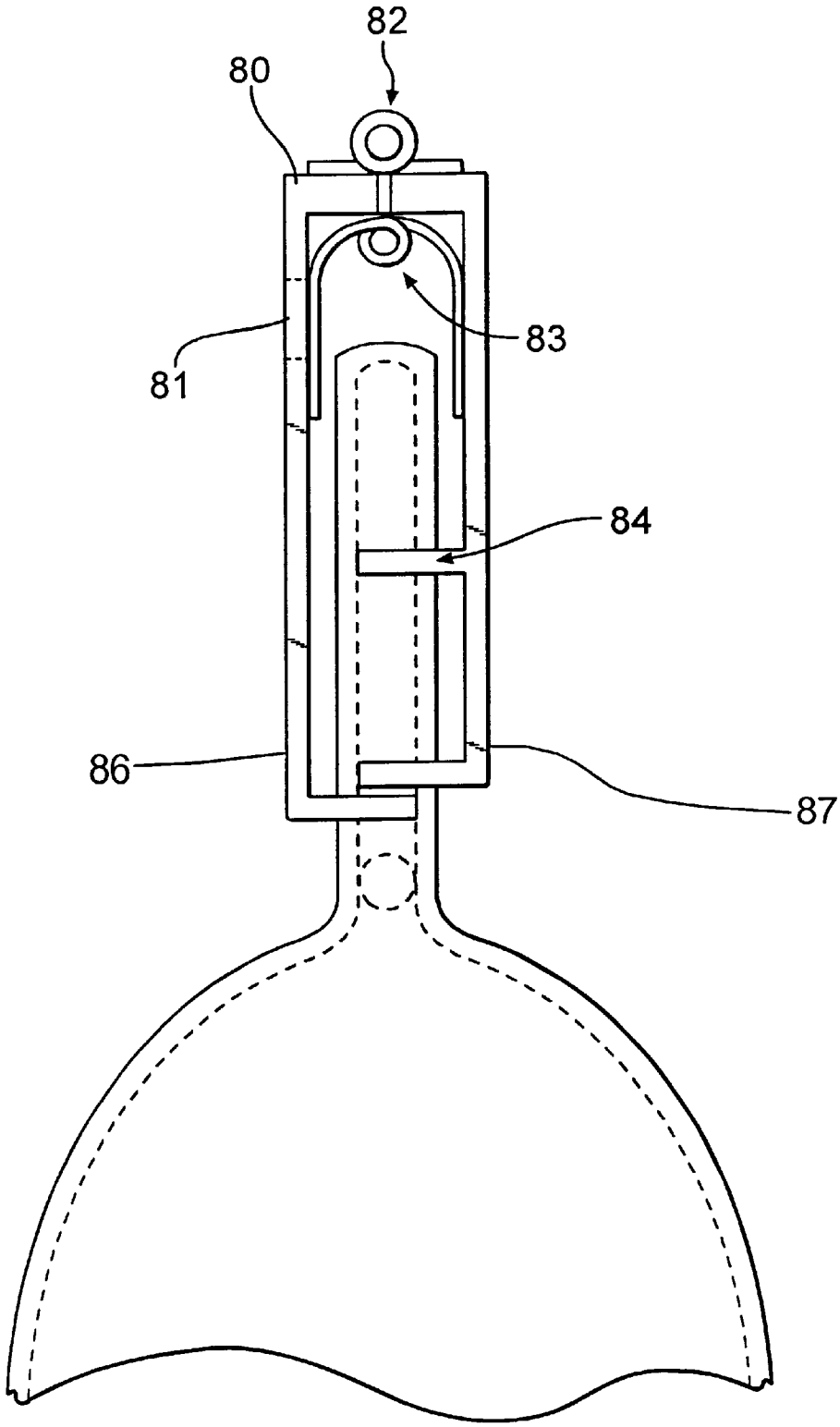
FIG. 8*b* shows a second view of the drop-clip crimping cup.

Further variations of the simple crimp-cap are envisioned, such as a drop wire booby trap as shown in FIGS. 8*a* and 8*b* where the holder (80) springs open when the cotter pin (85) is removed. The device can be affixed in various places by retaining means, such as a screw, tack or pin, in the mounting hole (81) The retaining means is used to hang the device from a chosen position such as a wall, branch or the like. The cotter-pin is then attached to a line so that when the line is fouled it pulls the cotter-pin (85) out of the spring cap, which is comprised of a first jaw (86) and a second jaw (87) with a common hinge (82) and an expanding spring means (83), and a center pin (84) that holds the neck of the paint reservoir. The two jaws then open under the spring force and drop the paint grenade.

Figure 9A:
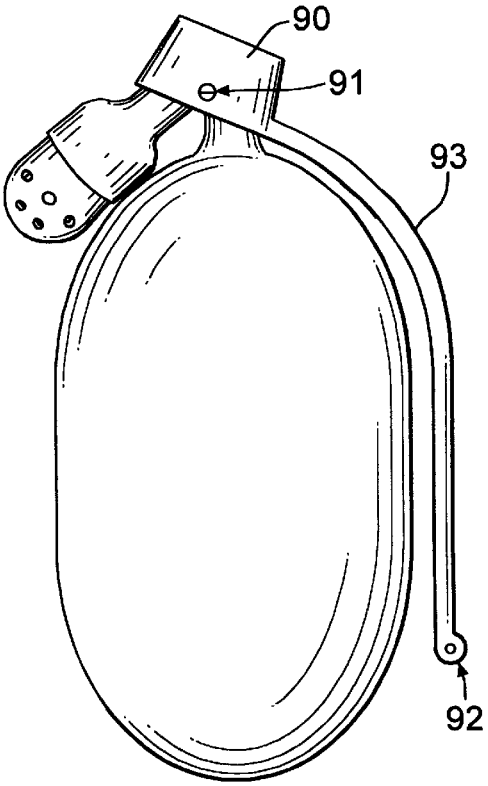
FIG. 9*a* shows a front view of a variation of the crimp cap with a release handle.
Figure 9B:
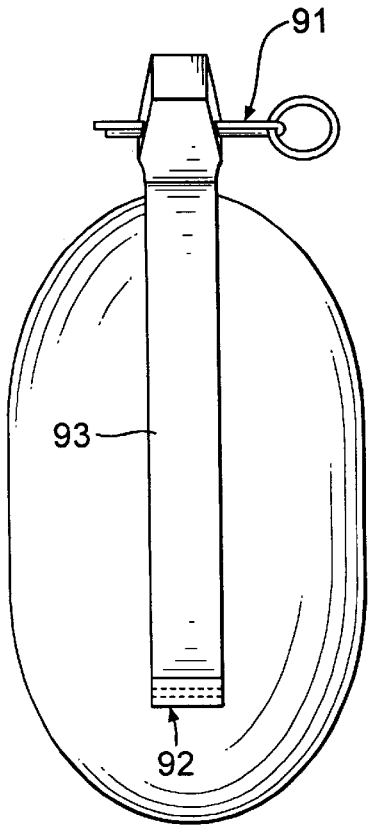
FIG. 9*b* shows an end view of a variation of the crimp cap with a release handle.

In another embodiment of the device as shown in FIGS. 9*a* and 9*b*, the crimping cup (90) extends as a handle shape (93) with a cotter-pin hole (91) and a trip-wire hole (92). A trip-wire can be connected to the trip-wire hole and the cotter-pin is removed to active the device While this invention has been described as having a specific design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A liquid spraying device with wide spray arc comprising:

a casing comprising an opened end for receiving a liquid under pressure, a holding end to accommodate said liquid under pressure, and a narrow neck region capable of being folded between said opened end and said holding end;

a ball received within said opened end for sealing said neck region between said opened end and said holding end to form a check valve, such that impact of said device will cause straightening of said narrow neck region to permit dislodging the ball by liquid pressure thereby dispensing liquid from said holding end through said opened end;

said opened end further comprising a nozzle affixed thereto, said nozzle comprising an attachment means for fixedly attaching said nozzle to said opened end wherein said nozzle comprises at least two liquid guiding holes.

2. A liquid spraying device as in claim 1 wherein said casing is comprised of a single seamless material.

3. A liquid spraying device as in claim 2 wherein said single seamless material is an elastic, nonporous material.

4. A liquid spraying device as in claim 1 wherein said liquid guiding holes are distributed throughout the surface of said nozzle such that said liquid spraying device will flail erratically as said liquid emerges from said nozzle.

5. A liquid spraying device as in claim 4 wherein said nozzle comprises two sets of liquid guiding holes, an upper set of liquid guiding holes and a lower set of liquid guiding holes;

said upper set of liquid guiding holes are equally spaced along an upper perimeter of the nozzle and are angularly pitched in an upright direction; and said lower set of liquid guiding holes, equally spaced along a lower perimeter of the nozzle, perpendicular to a longitudinal axis of the nozzle, wherein the center points of said liquid guiding holes are offset from the center point of the nozzle cavity in order to induce spin to said spraying device.

6. The device of claim 5 further comprising a crimping means for holding the check valve in the neck of said case.

7. The device of claim 6 wherein said crimping means is a trip-wire actuated release mechanism that operates by the trip-wire removing a cotter pin from said crimping means.

8. A liquid spraying device as in claim 1 wherein:

said ball is inserted into said neck region a distance sufficient to allow the opened end and a portion of the neck region to be folded to further secure the ball within the neck of said casing; and a cap covering and holding the folded portion of the casing with a pin extending thorough opposite ends of the cap and under the fold in the casing.

9. A liquid spraying device as in claim 1 wherein said liquid is a marking fluid.

* * * * *